US010761482B2

(12) United States Patent
Charbon et al.

(10) Patent No.: US 10,761,482 B2
(45) Date of Patent: Sep. 1, 2020

(54) COMPONENT FOR A TIMEPIECE MOVEMENT

(71) Applicant: Nivarox-FAR S.A., Le Locle (CH)

(72) Inventors: Christian Charbon, Chezard-St-Martin (CH); Vincent Fays, Peseux (CH); Marco Verardo, Les Bois (CH)

(73) Assignee: Nivarox-FAR S.A., Le Locle (CH)

( * ) Notice: Subject to any disclaimer, the term of this patent is extended or adjusted under 35 U.S.C. 154(b) by 3 days.

(21) Appl. No.: 15/652,288

(22) Filed: Jul. 18, 2017

(65) Prior Publication Data

US 2018/0024503 A1 Jan. 25, 2018

(30) Foreign Application Priority Data

| | | |
|---|---|---|
| Jul. 19, 2016 | (EP) | 16180226 |
| Sep. 23, 2016 | (EP) | 16190278 |
| Feb. 21, 2017 | (EP) | 17157065 |

(51) Int. Cl.

| | |
|---|---|
| ***G04B 13/02*** | (2006.01) |
| ***G04B 17/32*** | (2006.01) |
| ***G04B 15/14*** | (2006.01) |
| ***G04B 43/00*** | (2006.01) |
| ***G04B 1/16*** | (2006.01) |

(52) U.S. Cl.

CPC ..... *G04B 13/022* (2013.01); *G04B 1/16* (2013.01); *G04B 13/02* (2013.01); *G04B 13/026* (2013.01); *G04B 15/14* (2013.01); *G04B 17/32* (2013.01); *G04B 43/007* (2013.01)

(58) Field of Classification Search

CPC ..... G04B 1/16; G04B 13/02; G04B 15/14; G04B 13/026

See application file for complete search history.

(56) References Cited

U.S. PATENT DOCUMENTS

| | | | | |
|---|---|---|---|---|
| 6,755,566 B2 * | 6/2004 | Damasko | G04B 15/14 | 368/127 |
| 2002/0114225 A1 * | 8/2002 | Damasko | G04B 31/0123 | 368/125 |

(Continued)

FOREIGN PATENT DOCUMENTS

| | | |
|---|---|---|
| CH | 705 464 A2 | 3/2013 |
| EP | 2 437 125 A1 | 4/2012 |

(Continued)

OTHER PUBLICATIONS

European Search Report dated Mar. 1, 2017 in European Application 16180226, filed on Jul. 19, 2016 ( with English translation of Categories of Cited Documents).

(Continued)

*Primary Examiner* — Sean Kayes

(74) *Attorney, Agent, or Firm* — Oblon, McClelland, Maier & Neustadt, L.L.P.

(57) ABSTRACT

The invention relates to a timepiece component (1) comprising at least one portion (3) machined by chip removal. Said portion (3) is made of a non-magnetic copper alloy in order to limit its sensitivity to magnetic fields, said copper alloy containing between 10 wt % and 20 wt % of Ni, between 6 wt % and 12 wt % of Sn, X wt % of additional elements, wherein X is comprised between 0 and 5, and the remainder is Cu.

The invention concerns the field of timepiece movements.

21 Claims, 1 Drawing Sheet

(56) References Cited

U.S. PATENT DOCUMENTS

| | | | | |
|---|---|---|---|---|
| 2004/0231159 | A1 | 11/2004 | Shibuya et al. | |
| 2012/0113767 | A1* | 5/2012 | Marechal | G04B 31/02 368/287 |
| 2014/0198625 | A1* | 7/2014 | Von Gruenigen | G04B 1/16 368/124 |
| 2014/0261925 | A1* | 9/2014 | Wetzel | C22C 9/06 148/435 |
| 2017/0227931 | A1* | 8/2017 | Rossier | G04B 19/044 |
| 2017/0357213 | A1* | 12/2017 | Linck | G04B 15/14 |

FOREIGN PATENT DOCUMENTS

| | | | |
|---|---|---|---|
| EP | 2 757 423 | A1 | 7/2014 |
| EP | 2 860 591 | A1 | 4/2015 |
| FR | 2 015 873 | | 4/1970 |

OTHER PUBLICATIONS

Ametek: "datasheet Pfinodal", XP055350343, Dec. 1, 2010, 2 pages.

Lamineries Matthey Sa: "BrushForm 158/Toughmet™ 3", XP055350340, Edition Jun. 2013, Jun. 1, 2013, 3 pages.

Materion: "Materion Brush Performance Alloys Cold Rolled Temper Designations for BrushForm 158 Minimum 90° Bend Formability R/T Ratio Standard Designation ASTM Designation", BrushForm® 158 Cold Rolled Tempers, Xp055289069, Jan. 1, 2011, 2 pages.

Robert E. Kusner et al. "Engineering Guide: Toughmet 3AT (C72900), Toughmet 3CX (C96900)", XP055350479, Oct. 3, 2003, 16 pages.

* cited by examiner

COMPONENT FOR A TIMEPIECE MOVEMENT

This application claims priorities from European patent applications No. 16180226.9 filed on Jul. 19, 2016, No. 16190278.8 of Sep. 23, 2016 and No. 17157065.8 of Feb. 21, 2017, the entire disclosures of which are hereby incorporated herein by reference.

FIELD OF THE INVENTION

The invention relates to a component for a timepiece movement and particularly to a non-magnetic timepiece component for a mechanical timepiece movement and especially to a non-magnetic balance staff, a pallet staff and an escape pinion.

BACKGROUND OF THE INVENTION

The manufacture of a timepiece component comprising at least one part taking the form of a turned part, such as a timepiece pivot arbor, consists in performing chip removal machining operations on a hardenable steel bar, such as bar turning, to define different active surfaces (bearing surface, shoulder, pivots, etc.) and then subjecting the machined timepiece component to heat treatment operations comprising at least one hardening operation to improve the hardness of said component and one or more tempering operations to improve its tenacity. In the case of pivot arbors, the heat treatment operations may be followed by an operation of rolling the pivots of the arbors, which consists in polishing the pivots to the required dimensions. The hardness and roughness of the pivots are further improved during the rolling operation. It will be noted that this rolling operation is very difficult or even impossible to achieve with most materials of low hardness, i.e. less than 600 HV.

The pivot arbors, for example the balance staffs, conventionally used in mechanical timepiece movements are made of steel grades for bar turning which are generally martensitic carbon steels comprising lead and manganese sulphides to improve their machinability. A known steel of this type, named 20AP, is typically used for these applications.

This type of material has the advantage of being easy to machine, in particular of being suitable for bar turning and, after hardening and tempering, has superior mechanical properties which are very advantageous for making timepiece pivot arbors. These steels have, in particular, superior wear resistance and hardness after heat treatment. Typically, the hardness of arbor pivots made of 20AP steel can exceed 700 HV after heat treatment and rolling.

Although this type of material provides satisfactory mechanical properties for the horological applications described above, it has the drawback of being magnetic and capable of interfering with the working of a watch after being subjected to a magnetic field, particularly when the material is used to make a balance staff cooperating with a balance spring made of ferromagnetic material. This phenomenon is well known to those skilled in the art. It will also be noted that these martensitic steels are also sensitive to corrosion.

Attempts have been made to try to overcome these drawbacks with austenitic stainless steels, which have the peculiarity of being non-magnetic, namely paramagnetic or diamagnetic or antiferromagnetic. However, these austenitic steels have a crystallographic structure, which does not allow them to be hardened and to achieve levels of hardness and thus of wear resistance compatible with the requirements necessary for making timepiece pivot arbors. One means of increasing the hardness of these steels is cold working, however this hardening operation cannot achieve hardnesses of more than 500 HV. Consequently, for parts requiring high resistance to wear due to friction and requiring pivots which have little or no risk of deformation, the use of this type of steel remains limited.

Another approach for attempting to overcome these drawbacks consists in depositing hard layers of materials such as diamond-like-carbon (DLC) on the pivot arbors. However, there have been observed significant risks of delamination of the hard layer and thus the formation of debris which can move around inside the timepiece movement and disrupt the operation of the latter, which is unsatisfactory.

A similar approach, described in FR Patent 2015873, proposes to make a balance staff wherein at least the main part is made of certain non-magnetic materials. The pivots may be made of this same material or of steel. It is also possible to arrange for the deposition of an additional layer applied by galvanic or chemical means or by gas phase (for example of Cr, Rh, etc.). This additional layer presents a significant risk of delamination. This document also describes a balance staff fabricated entirely of hardenable bronze. However, no information is provided as to the method for fabricating the pivots. Further, a component made of hardenable bronze has a hardness of less than 450 HV. Such a hardness seems insufficient for performing a rolling treatment to those skilled in the art.

There are also known, from EP Patent Application 2757423, pivot arbors made of an austenitic alloy of cobalt or nickel and having an outer surface hardened to a certain depth. However, such alloys may prove difficult to machine by chip removal. Moreover, they are relatively expensive because of the high cost of nickel and cobalt.

SUMMARY OF THE INVENTION

It is an object of the invention to overcome all or part of the aforementioned drawbacks by proposing a timepiece component which both limits sensitivity to magnetic fields and can achieve an improved hardness compatible with the demands for wear and shock resistance required in the horological industry.

It is also an object of the invention to provide a non-magnetic timepiece component having improved corrosion resistance.

It is yet another object of the invention to provide a non-magnetic timepiece component which can be manufactured simply and economically.

To this end, the invention relates to a timepiece component for a timepiece movement comprising at least one portion machined by chip removal.

According to the invention, said portion is made of a non-magnetic copper alloy in order to limit its sensitivity to magnetic fields, said copper alloy containing between 10 wt % and 20 wt % of Ni, between 6 wt % and 12 wt % of Sn, X wt % of additional elements, wherein X is comprised between 0 and 5 wt %, and the remainder is Cu.

Such a timepiece component makes it possible to combine advantages such as low sensitivity to magnetic fields, hardness and good corrosion resistance, while still maintaining good general tenacity. Moreover, the use of a non-magnetic copper alloy as defined above is advantageous inasmuch as the latter is highly machinable.

It is possible to improve the hardness of at least the portion machined by chip removal. In such case, according to a first variant embodiment, at least the portion machined by chip removal comprises a hardening layer deposited on an outer surface of said portion.

According to another variant embodiment for improving hardness, at least an outer surface of said portion machined by chip removal is deep-hardened with respect to the core of the timepiece component to a predetermined depth.

Consequently, a surface area or the entire surface of the timepiece component is hardened, i.e. the core of the component may remain little modified or unmodified. Through this selective hardening of portions of the timepiece component, it is possible for the timepiece component to exhibit, in addition to the advantages indicated above, improved hardness in the main stress areas.

Moreover, the invention relates to a timepiece movement comprising a timepiece component according to any of the preceding variants. Said timepiece component is, for example, a pivot arbor, with the portion machined by chip removal being at least one pivot. In particular, the timepiece component may be a balance staff, a pallet staff and/or an escape pinion, or a screw, a winding stem, a balance spring stud, etc. . . . .

Finally, the invention relates to a method for manufacturing a timepiece component for a timepiece movement comprising the following steps:

a1) taking an element machinable by chip removal, said element being made of a non-magnetic copper alloy containing between 10 wt % and 20 wt % of Ni, between 6 wt % and 12 wt % of Sn, X wt % of additional elements, wherein X is comprised between 0 and 5, and the remainder is Cu.

b1) forming said timepiece component c1) machining said timepiece component by chip removal to form at least one portion of said timepiece component that is machined by chip removal and made of said non-magnetic copper alloy.

The invention also relates to a method for manufacturing a timepiece component for a timepiece movement comprising the following steps:

a2) taking an element machinable by chip removal, said element being made of a non-magnetic copper alloy containing between 10 wt % and 20 wt % of Ni, between 6 wt % and 12 wt % of Sn, X wt % of additional elements, wherein X is comprised between 0 and 5, and the remainder is Cu.

b2) chip removal machining said element to form at least one portion of said timepiece component c2) forming the timepiece component comprising said portion obtained in step b2).

To improve the hardness of at least the portion machined by chip removal, the methods of the invention may comprise, according to a first variant, a step d) of depositing a hardening layer on at least an outer surface of said portion machined by chip removal.

According to another variant for improving hardness, the methods of the invention may comprise a step e) of diffusing atoms to a predetermined depth in at least an outer surface of said portion machined by chip removal, in order to deep-harden the timepiece component in the main stress areas while maintaining high tenacity.

Consequently, by diffusing atoms in the copper alloy used in the present invention, a surface area or the entire surface of the portion machined by chip removal is hardened without having to deposit a second material over said portion. Indeed, the hardening occurs within the material of the timepiece component which, advantageously according to the invention, prevents any subsequent delamination which can occur in the case where a hard layer is deposited on the timepiece component.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

In the present description, the term "non-magnetic" means a paramagnetic or diamagnetic or antiferromagnetic material, whose magnetic permeability is less than or equal to 1.01.

The term "chip removal machining" refers to any shaping operation by removal of material intended to give a component dimensions and a surface state within a given tolerance range. Such operations are, for example, bar turning, milling or any other technique known to those skilled in the art.

The invention relates to a component for a timepiece movement and particularly to a non-magnetic timepiece component, such as a pivot arbor, for a mechanical timepiece movement.

The invention will be described below with reference to an application to a non-magnetic balance staff 1. Of course, other types of timepiece pivot arbors may be envisaged such as, for example, timepiece wheel set arbors, typically escape pinions or pallet staffs. Components of this type have a body with a diameter preferably less than 2 mm, and pivots with a diameter preferably less than 0.2 mm, with a precision of several microns. Other timepiece components that may be envisaged are screws, winding stems, balance spring studs, etc., and may have similar dimensions to those mentioned above for the arbors_.

Figure 1:
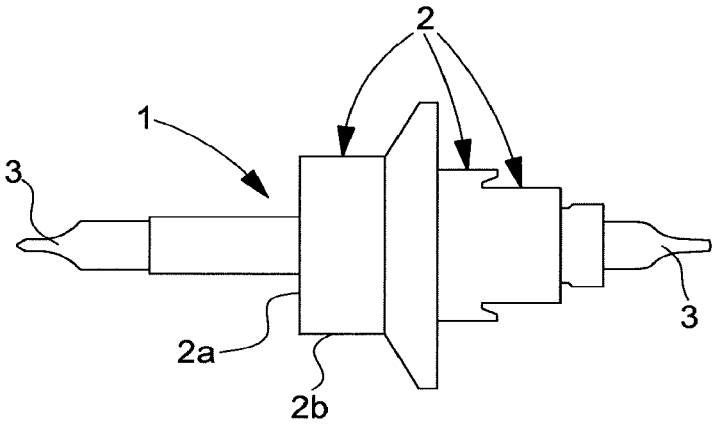
FIG. 1 is a representation of a timepiece component according to the invention.

Referring to FIG. 1, there is shown a balance staff 1 according to the invention, which comprises a plurality of sections 2 of different diameters, preferably formed by bar turning or any other chip removal machining technique, and defining, in a conventional manner, bearing surfaces 2*a* and shoulders 2*b* arranged between two end portions defining two pivots 3. These pivots are each intended to pivot in a bearing typically in an orifice in a jewel or ruby.

With the magnetism induced by objects that are encountered on a daily basis, it is important to limit the sensitivity of balance staff 1 to avoid affecting the working of the timepiece in which it is incorporated.

Surprisingly, the invention overcomes both problems at the same time with no comprise and while providing additional advantages. Thus, at least portion 3 of timepiece component 1, formed by chip removal machining, is made of a non-magnetic copper alloy so as to advantageously limit its sensitivity to magnetic fields, said copper alloy comprising between 10 wt % and 20 wt % of Ni, between 6 wt % and 12 wt % of Sn, X wt % of additional elements, wherein X is comprised between 0 and 5, and the remainder is Cu.

Preferably, the non-magnetic copper alloy contains between 11 wt % and 18 wt % of Ni, between 7 wt % and 10 wt % of Sn, X wt % of additional elements, wherein X is comprised between 0 and 5, and the remainder is Cu.

In a particularly preferred manner, the non-magnetic copper alloy comprises between 12 wt % and 17 wt % of Ni, between 7 wt % and 9 wt % of Sn, X wt % of additional elements, wherein X is comprised between 0 and 5, and the remainder is copper.

In a particularly preferred manner, the non-magnetic copper alloy comprises between 14.5 wt % and 15.5 wt % of Ni, between 7.5 wt % and 8.5 wt % of Sn, X wt % of additional elements, wherein X is comprised between 0 and 5, and the remainder is copper.

The proportions of the various alloying elements are chosen to give the alloys both non-magnetic properties and good machinability.

Advantageously, the non-magnetic copper alloy used in the invention may be lead free or may contain lead in an amount less than or equal to 0.02 wt %.

Advantageously, the non-magnetic copper alloy may be an alloy having a mass percent composition of between 14.5% and 15.5% of Ni, between 7.5% and 8.5% of Sn, at most 0.02% of Pb and the remainder of Cu. Such an alloy is marketed under the trademark ToughMet® by Materion.

Of course, other non-magnetic copper-based alloys meeting the definition of the invention may be envisaged, provided the proportion of their constituents confers both non-magnetic properties and good machinability.

At least portion 3 of timepiece component 1 has a hardness of more than 350 HV.

In a surprising and unexpected manner, portion 3 made of a copper alloy as defined above can be rolled, despite having a hardness of less than 600 HV.

In order to improve the hardness of at least the chip removal machined portion 3, it is possible, according to a first variant of the invention, to provide a hardening layer deposited on at least an outer surface of said portion 3. Such an additional layer may be a layer of TiN, diamond, DLC, $Al_2O_3$, Cr, Ni, NiP or any other suitable material, deposited by PVC, CVD, ALD or galvanic methods or any other suitable method.

Figure 2:
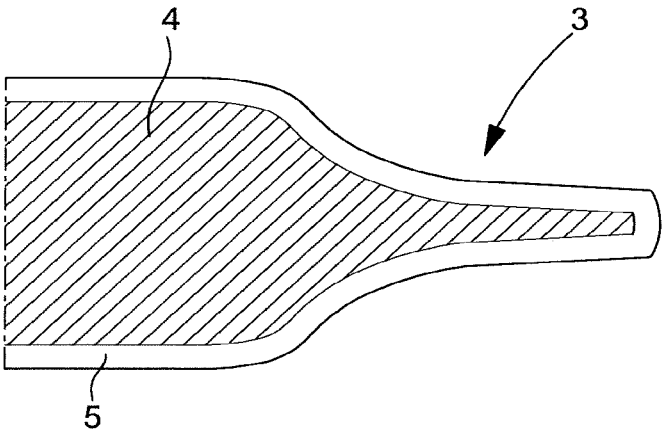
FIG. 2 is a partial cross-section of a chip removal machined portion of the timepiece component according to a variant of the invention, after a diffusion treatment operation and after a rolling or polishing operation.

According to another variant of the invention, the hardness of at least chip removal machined portion 3 can be improved by arranging for the outer surface 5 of said portion 3 (FIG. 2) to be deep-hardened to a predetermined depth with respect to the rest of the timepiece component, so as to offer, advantageously according to the invention, a superior hardness on said outer surface while maintaining high tenacity. The predetermined depth represents between 5% and 40% of the total diameter d of portion 3, typically between 5 and 35 microns.

The deep-hardened outer surface of portion 3 thus treated may have a hardness of more than 600 HV.

It has been empirically demonstrated that a hardening depth of between 5% and 40% of the total diameter d of portion 3 is sufficient for example for the application to a balance staff, in which case portion 3 is a pivot. By way of example, if the radius d/2 is 50 μm, the hardening depth is preferably approximately 15 μm all over portion 3, such as the pivots. Evidently, depending upon the application, it is possible to provide a different hardening depth of between 5% and 80% of the total diameter d.

Preferably, the deep-hardened outer surface 5 of portion 3 comprises diffused atoms of at least one chemical element. Said chemical element is, for example, a non-metal chemical element such as nitrogen, argon and/or boron. Indeed, as explained below, through the interstitial supersaturation of atoms in non-magnetic copper alloy 4, a surface area 5 is deep-hardened with no need to deposit a second material over portion 3. Indeed, the hardening occurs within the material 4 of portion 3 which advantageously prevents any subsequent delamination during use. Consequently, according to this variant of the invention, outer surface 5 of portion 3 comprises a hard surface layer, but has no additional hardening layer deposited directly on said outer surface 5.

Consequently, at least a surface area of the portion 3 is hardened, i.e. the core of portion 3 and/or the rest of timepiece component 1 may remain little modified or unmodified without any significant change to the mechanical properties of said timepiece component 1. This selective hardening of chip removal machined portion 3 of timepiece component 1 makes it is possible to combine advantages, such as low sensitivity to magnetic fields, hardness and high tenacity, in the main areas of stress, while offering good resistance to corrosion and fatigue.

It is evident that layers other than hardening layers may be deposited, for example lubrication layers.

The invention also relates to a first method for manufacturing a timepiece component 1, as explained above. The method of the invention advantageously comprises the following steps:

a1) taking a chip removal machinable element, such as a bar, said element being made of a non-magnetic copper alloy containing between 10 wt % and 20 wt % of Ni, between 6 wt % and 12 wt % of Sn, X wt % of additional elements, wherein X is comprised between 0 and 5, and the remainder is Cu.

b1) forming timepiece component 1 c1) chip removal machining said timepiece component to form at least one portion 3 of said timepiece component 1 that is machined by chip removal and made of said non-magnetic copper alloy.

The invention also relates to a second method for manufacturing a timepiece component 1 as explained above. According to the invention, this method advantageously comprises the following steps:

a2) taking a chip removal machinable element, such as a bar, said element being made of a non-magnetic copper alloy containing between 10 wt % and 20 wt % of Ni, between 6 wt % and 12 wt % of Sn, X wt % of additional elements, wherein X is comprised between 0 and 5, and the remainder is Cu.

b2) chip removal machining said element to form at least one portion 3 of said timepiece component 1 c2) forming timepiece component 1 comprising said portion 3 obtained in step b2).

The alloys used in the present invention are hardenable by a heat treatment known as spinodal decomposition. To achieve this, the chip removal machinable element must be subjected to the following steps of:

dissolution cold working hardening heat treatment by spinodal decomposition (360° C.-370° C. for 2 to 4 hours).

Consequently, according to a first possibility, the chip removal machinable element used in the present invention can be used in step a1) or step a2) in an intermediate form in which it has only undergone the dissolution and cold working steps. Step c1) or b2) of chip removal machining is, in that case, performed on a relatively soft, chip removal machinable element. The hardening heat treatment by spinodal decomposition is then performed on the machined element.

According to a second possibility, the chip removable machinable element used in the present invention can be used in step a1) or a2) in its final form, in which it has undergone the three treatment steps, namely dissolution, cold working and the hardening heat treatment by spinodal decomposition. Step c1) or c2) of chip removal machining is then performed directly on a hard, chip removal machinable element, which does not require any subsequent hardening heat treatment by spinodal decomposition.

In order to improve the hardness of at least portion 3, the method of the invention may advantageously comprise, according to a first variant, a step d) of depositing a hardening layer at least over an outer surface 5 of said chip removal machined portion 3. Preferably, step d) may consist of a deposition by PVD, CVD, ALD, galvanic processes, or any other suitable process, of a layer of TiN, diamond, DLC, $Al_2O_3$, Cr, Ni, NiP or any other suitable material.

In order to improve the hardness of at least portion 3, the method of the invention may advantageously comprise, according to a second variant, a step e) of diffusing atoms to a predetermined depth in at least outer surface 5 of said portion 3 machined by chip removal, in order to deep-harden timepiece component 1 in the main stress areas while maintaining high tenacity. The predetermined depth preferably represents between 5% and 40% of the total diameter d of said chip removal machined portion 3.

Advantageously according to the invention, whichever embodiment is selected, the method can be applied in bulk. Thus, step e) may consist of a thermochemical diffusion treatment, such as bonding several timepiece components and/or several timepiece component blanks. It is understood that step e) may consist of the interstitial diffusion in non-magnetic copper alloy 4 of the atoms of at least one chemical element, for example a non-metal such as nitrogen, argon and/or boron. Finally, advantageously, the compressive stresses of the method improve fatigue and shock resistance.

Step e) could also consist of an ion implantation process which may or may not be followed by a diffusion heat treatment. This variant has the advantage of not limiting the type of diffused atoms and of allowing both interstitial and substitutional diffusion.

When the treatment implemented in step e) is an ion implantation process, the depth of hardening of outer surface 5 may advantageously be increased with the aid of a heat treatment performed during or after the ion implantation treatment step b).

The method of the invention may also comprise other steps of depositing a layer other than a hardening layer. For example, the method of the invention may comprise a step of depositing a lubrication layer.

Advantageously, at least the chip removal machined portion 3 can be subjected to a rolling/polishing operation after step c1) or b2) when there is no complementary hardening treatment, or after step d) or e) in the case of a complementary hardening treatment. Consequently, at least outer surface 5 of portions 3 of the invention may appear rolled. This rolling/polishing operation makes it possible to achieve the dimensions and the surface state desired for portions 3, especially in the case of pivots. This post treatment rolling operation makes it possible to obtain timepiece components presenting improved resistance to wear and shocks compared to timepiece components whose chip removal machined portions have simply been subjected to a hardening operation.

The timepiece component according to the invention may comprise chip removal machined portions treated according to the invention and mounted on the body of the timepiece component or be made entirely of non-magnetic copper alloy as defined above according to one of the methods of the invention. Further, the hardening treatment in step d) or e) may be performed on the surface of the chip removal machined portions or over the entire surfaces of the timepiece component.

The timepiece component according to the invention may advantageously be made by bar turning or any other chip removal machining technique using bars made of non-magnetic copper alloy as defined above, preferably having a diameter less than 3 mm, and preferably less than 2 mm. Such bars do not currently exist on the market and must be specifically prepared, which proves that those skilled in the art would be put off by the idea of using a non-magnetic copper based alloy as defined above to form a timepiece component by bar turning or any other chip removal machining technique, possibly followed by rolling. Copper alloys are known to those skilled in the art as being too soft to be able to be rolled and for wear resistance during use. However, in a surprising and unexpected manner, the use of such materials according to the invention makes it possible to make pivot arbors that can undergo rolling and achieve satisfactory longevity in use. To achieve the present invention, those skilled in the art had to overcome bias to use a non-magnetic copper based alloy to make a timepiece component of very small dimensions by means of a method comprising a step of bar turning (or any other chip removal machining method) and possibly a rolling step.

Against all expectations, the method of the invention makes it possible to obtain a timepiece component wherein at least the portions formed by bar turning (or any other chip removal machining technique) and possibly by rolling are made using a non-magnetic copper alloy as defined above.

Of course, the present invention is not limited to the illustrated example but is capable of various variants and modifications which will be clear to those skilled in the art. In particular, it is possible to envisage treating all or virtually all of portions 3, i.e. treating more than 80% of the diameter d of portions 3, although this is not necessary for application to timepiece components such as timepiece balance staffs.

What is claimed is:

1. A timepiece component comprising at least one portion machined by chip removal, wherein said portion is made of a non-magnetic copper alloy in order to limit the sensitivity thereof to magnetic fields, said copper alloy containing between 10 wt % and 20 wt % of Ni, between 6 wt % and 12 wt % of Sn, X wt % of additional elements, wherein X is comprised between 0 and 5, and the remainder is Cu, wherein the component consists of a pivot arbor, the portion machined by chip removal being at least a pivot, wherein at least the portion machined by chip removal comprises a hardening layer deposited on an outer surface of said portion, and the hardening layer is a layer of TiN, diamond, DLC, $Al_2O_3$, CR, or NiP.

2. The timepiece component according to claim 1, wherein said copper alloy comprises lead, in an amount less than or equal to 0.02 wt %.

3. The timepiece component according to claim 1, wherein at least an outer surface of said portion machined by chip removal is deep-hardened with respect to the core of the timepiece component to a predetermined depth.

4. The timepiece component according to claim 3, wherein the predetermined depth represents between 5% and 40% of the total diameter (d) of said portion machined by chip removal.

5. The timepiece component according to claim 3, wherein the deep-hardened outer surface comprises diffused atoms of at least one chemical element.

6. A movement for a timepiece, wherein the movement comprises a timepiece component according to claim 1.

7. A method for fabrication of a timepiece component according to claim 1 for a timepiece movement, the method comprising:

a1) taking an element machinable by chip removal, said element being made of a non-magnetic copper alloy containing between 10 wt % and 20 wt % of Ni, between 6 wt % and 12 wt % of Sir, X wt % of additional elements, wherein X is comprised between 0 and 5, and the remainder is Cu;

b1) forming the timepiece component;

c1) chip removal machining said timepiece component to form at least one portion of said timepiece component that is machined by chip removal and made of said non-magnetic copper alloy; and d1) depositing a hardening layer at least on an outer surface of said portion machined by chip removal.

8. The method according to claim 7, wherein the method further comprises e) diffusing atoms to a predetermined depth in at least an outer surface of said portion machined by chip removal in order to deep-harden the timepiece component in the main stress areas while maintaining high tenacity.

9. The method according to claim 8, wherein the predetermined depth represents between 5% and 40% of the total diameter (d) of said portion machined by chip removal.

10. The method according to claim 8, wherein the diffusion comprises the diffusion of atoms of at least one chemical element.

11. The method according to claim 8, wherein the diffusing e) consists of a thermochemical diffusion treatment.

12. The method according to claim 8, wherein the diffusing e) consists of an ion implantation process which may or may not be followed by a diffusion treatment.

13. The method according to claim 7, wherein said portion machined by chip removal is subjected to a rolling/polishing after c1) or after d1) depositing a hardening layer at least on an outer surface of said portion machined by Chip removal or e) diffusing atoms to a predetermined depth in at least am outer surface of said portion machined by Chip removal in order to deep-harden the timepiece component in the main stress areas while maintaining high tenacity.

14. A method for fabrication of a timepiece component according to claim 1 for a timepiece movement, the method comprising:

a2) taking an element machinable by chip removal, said element being made of a non-magnetic copper alloy containing between 10 wt % and 20 wt % of Ni, between 6 wt % and 12 wt % Sit, X wt % of additional elements, wherein X is comprised between 0 and 5, and the remainder is Cu;

b2) chip removal machining said element to form at least one portion of said timepiece component;

c2) forming the timepiece component comprising said portion obtained in step b2); and d2) depositing a hardening layer at least on an outer surface of said portion machined by chip removal.

15. The method according to claim 14, wherein the method further comprises e) diffusing atoms to a predetermined depth in at least an outer surface of said portion machined by chip removal in order to deep-harden the timepiece component in the main stress areas while maintaining high tenacity.

16. The method according to claim 15, wherein the predetermined depth represents between 5% and 40% of the total diameter (d) of said portion machined by chip removal.

17. The method according to claim 15, wherein the diffusion comprises the diffusion of atoms of at least one chemical element.

18. The method according to claim 15, wherein the diffusing e) consists of a themiochemical diffusion treatment.

19. The method according to claim 15, wherein the diffusing e) consists of an ion implantation process which may or may not be followed by a diffusion treatment.

20. The method according to claim 14, wherein said portion machined by chip removal is subjected to a rolling/polishing after b2) or after d2) depositing a hardening layer at least on an outer surface of said portion machined by chip removal or e) diffusing atoms to a predetermined depth in at least an outer surface of said portion machined by chip removal in order to deep-harden the timepiece component in the main stress areas while maintaining high tenacity.

21. The timepiece component according to claim 1, wherein the pivot has a diameter of less than 0.2 mm.

* * * * *